United States Patent [19]

Blumle

[11] Patent Number: 4,583,729

[45] Date of Patent: Apr. 22, 1986

[54] VACUUM CONTROL DEVICE

[75] Inventor: Martin Blumle, Gullesheim, Fed. Rep. of Germany

[73] Assignee: Winkler+Dunnebier Maschinenfabrik und Eisengiesserei GmbH & Co., Neuwied, Fed. Rep. of Germany

[21] Appl. No.: 550,490

[22] Filed: Nov. 9, 1983

[30] Foreign Application Priority Data

Nov. 12, 1982 [DE] Fed. Rep. of Germany ..... 3241869

[51] Int. Cl.[4] ..... B65H 3/08

[52] U.S. Cl. ..... 271/276; 271/96; 271/108; 271/196

[58] Field of Search ..... 271/94, 95, 96, 108, 271/276, 194, 196

[56] References Cited

U.S. PATENT DOCUMENTS

| | | | |
|---|---|---|---|
| 2033849 | 3/1936 | Mudd | 271/94 |
| 2,867,438 | 1/1959 | Hori | 271/96 |
| 3,915,448 | 10/1975 | Total | 271/96 |
| 4,390,174 | 6/1983 | Veith | 271/108 |

*Primary Examiner*—Bruce H. Stoner, Jr.
*Assistant Examiner*—John A. Carroll
*Attorney, Agent, or Firm*—Collard, Roe & Galgano

[57] ABSTRACT

A device for controlling the vacuum at a rotating vacuum cylinder in a high speed paper converting machine by means of a control head having a conical shape which is supported coaxially therewith and which is secured against rotation. The conically shaped control head is telescoped into a complementarily shaped opening in the vacuum cylinder with an exact fit. The two cooperating control surfaces lie on the outer cone surface of the control head and on the inner cone surface of the vacuum cylinder.

2 Claims, 1 Drawing Figure

VACUUM CONTROL DEVICE

Figure 1:
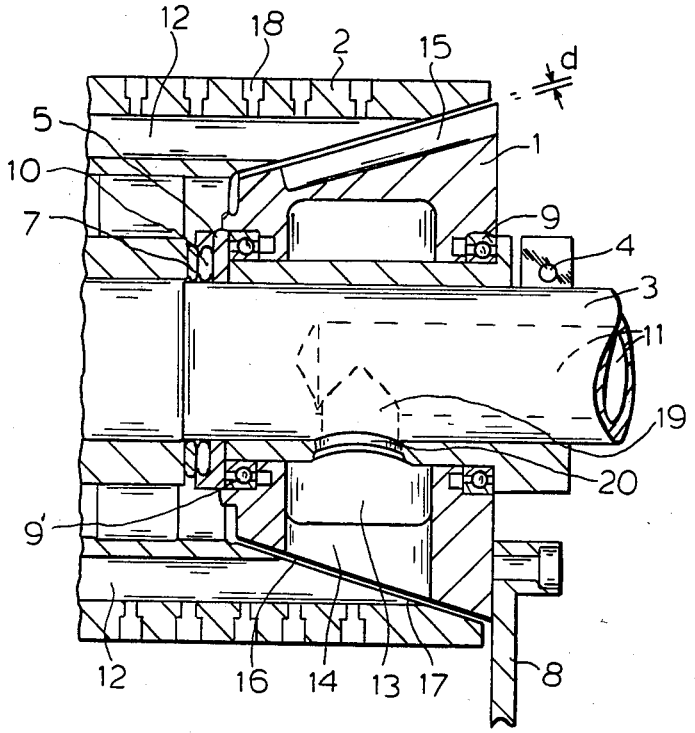

The present invention relates to a device for controlling the vacuum at a rotating vacuum cylinder in a high speed paper converting machine by means of a rotationally-secure, radially adjustable control head which is supported coaxially thereto and is telescoped with its control surface into the vacuum cylinder.

In such devices control is performed in such a way that the vacuum bore of the vacuum cylinder rotates with its control slot past a vacuum section. The vacuum cylinder is arranged radially and is supported with its control slot in the control head which in turn is supported so as to be free from rotation. The control head consists of a vacuum canal, a cover section and a canal for atmospheric air pressure and is acted upon in the process by vacuum or atmospheric pressure. An example of such a control head is disclosed in U.S. Pat. No. 4,390,174, to Veith, granted June 28, 1983.

It is known to design a coaxially supported control head of this type in such a manner that its end face serves as the control surface. Between this control surface and the control surface of the cooperating vacuum cylinder, the spacing of the vacuum gap is adjusted so that, on the one hand, little vacuum is lost and that, on the other hand, the control surfaces do not touch each other mechanically. Due to the vacuum continuously present in the vacuum canal, a force is produced which acts at right angles to the control surface. The effect of this is that the control head is tilted and the control surfaces of the control head and the vacuum cylinder touch each other mechanically and seize. In practice, a larger vacuum gap must be adjusted in this vacuum control device which, however, results in a costly vacuum loss and too low vacuum at the vacuum exit holes. In addition, this control requires more space because the control head is arranged adjacent to the vacuum cylinder.

A further variant of coaxially supported vacuum control heads has a cylinder base shape, the cylindrical outer shell functioning as the control surface. While this control head is arranged within the vacuum cylinder in a space-saving manner, it is a disadvantage that the vacuum gap between its control surface and the control surface of the cooperating vacuum cylinder can be adjusted only by mechanial finishing of its outside diameter.

It is an object of the present invention to develop a device for controlling vacuum, the control head of which does not tilt, is arranged partly in the vacuum cylinder in a space-saving manner, and the vacuum gap of which can be adjusted simply and with sensitivity.

According to the present invention, this object is achieved by providing a control head having the shape of a truncated cone, the control surface of the control head being the cone shell on which vacuum canals, cover sections and canals for atmospheric pressure are arranged. The control surface of the cooperating vacuum cylinder is that of a complementary cone surface which contains the control slots of the vacuum bores. The vacuum gap between the control surfaces of the control head and the vacuum cylinder can be adjusted with sensitivity and precisely by changing the means for axial fixation.

The primary advantages which result from the present invention are that the control head is arranged within the vacuum cylinder in a space-saving manner and cannot be tilted because the force produced by the vacuum in the vacuum canal acts in the center of the control head between two bearings. Further major advantages are that the vacuum gap between the control surfaces of the vacuum cylinder and the vacuum head can be adjusted easily and sensitively due to the conical design, and the vacuum bore of the vacuum cylinder which opens into the conical control surface automatically results in a desired elliptical control slot.

FIG. 1 is a cross-sectional view of the vacuum control device of the present invention.

As seen in the drawing, the device for controlling vacuum consists of a revolving vacuum cylinder 2 having a control surface 17 on its internal cone shaped surface and a control head 1 which has a shape similar to a truncated cone with its control surface 16 on its outer cone surface. The outer cone surface of control head 1 is telescoped into the internal cone shaped surface of vacuum cylinder 2.

Vacuum cylinder 2 is mounted on rotating shaft 3 concentrically in a form-locking or frictional manner. The vacuum exit bores 18 of vacuum cylinder 2 are connected to control surface 17 thereof by vacuum bores 12.

Control head 1, which is fixed free from rotation by means of control head holder 8, is supported coaxially on, and relatively moveable with, rotating shaft 3 via ball bearings 9 and 9' and clamping bushing 4. Axially, the control head 1 is braced by pressure ring 5, axial bearing 10 and spacer ring 7 against vacuum cylinder 2. Control surface 16 of control head 1 communicates with the vacuum source via vacuum canal 14, circular slot 13, bore 20 in bushing 4, transverse bore 19 in shaft 3, coaxial supply bore 11 in shaft 3 and parts not described in detail herein. Canal 15 on control surface 16 serves for the equalization of the pressure and is open to the atmosphere.

Vacuum gap d is adjusted by changing the thickness of spacer washer 7. The time adjustment of the vacuum and the delivery point at vacuum cylinder 2 is made by radial rotation of the control head 1 by the control head holder 8.

In operation, vacuum cylinder 2 rotates with the control slot, into which vacuum bore 12 on control surface 17 opens, and passes the vacuum path of control surface 16 once per revolution. In this process it is acted upon through vacuum canal 14 by vacuum and subsequently by atmospheric air pressure through canal 15.

It is understood that the foregoing general and detailed descriptions are explanatory of the present invention and are not to be interpreted as restrictive of the scope of the following claims.

What is claimed is:

1. A device for controlling the vacuum at a revolving vacuum cylinder fixedly mounted to a rotating shaft, said device including:

a control head fixed to be fee of rotation having the shape of a truncated cone and defining a control surface on the conical surface thereof, said control head being coaxially and rotatably mounted on said shaft;

vacuum canals, cover sections and canals for atmospheric pressure arranged on the conically shaped control surface of said control head;

a conically shaped control surface formed internally in said vacuum cylinder corresponding to the shape of the conical control surface of said control head, said vacuum cylinder control surface including the control slots of the vacuum bores of said vacuum cylinder, said control head being telescoped into the internal conical shape of said vacuum cylinder defining a vacuum gap between the control surfaces thereof;

means for rotatably adjusting said control head so as to adjust the timing of vacuum delivery to said vacuum cylinder; and means for adjusting the vacuum gap between the control surfaces of the control head and the vacuum cylinder by adjusting the relative axial positions between said control head and said vacuum cylinder.

2. The device as defined in claim 1, wherein vacuum is supplied centrally through the shaft and is supplied to the suction canal of said control head by means of a circular slot internally in said control head communicating with the vacuum supply in said shaft.

* * * * *